US005970789A

United States Patent [19]

Meyer et al.

[11] Patent Number: 5,970,789

[45] Date of Patent: Oct. 26, 1999

[54] METHOD AND APPARATUS FOR EVALUATING A SUPPORT SURFACE

[75] Inventors: Eric R. Meyer, Greensburg; David J. Ulrich, Sunman, both of Ind.

[73] Assignee: Hill-Rom, Inc., Batesville, Ind.

[21] Appl. No.: 08/752,796

[22] Filed: Nov. 20, 1996

[51] Int. Cl.[6] ..... A47C 31/12

[52] U.S. Cl. ..... 73/172

[58] Field of Search ..... 73/172

[56] References Cited

U.S. PATENT DOCUMENTS

| | | | |
|---|---|---|---|
| 2,154,561 | 4/1939 | Breer et al. | 73/172 |
| 2,378,039 | 6/1945 | Schenker | 73/172 |
| 2,644,332 | 7/1953 | Ulrich . | |
| 3,195,347 | 7/1965 | Janapol | 73/172 |
| 3,334,517 | 8/1967 | Janapol . | |
| 3,413,849 | 12/1968 | Janapol | 73/172 |
| 4,267,728 | 5/1981 | Manley et al. | 73/172 |
| 4,669,302 | 6/1987 | Wagner et al. | 73/172 |
| 4,827,763 | 5/1989 | Bourland et al. | 73/172 |
| 4,964,302 | 10/1990 | Grahn et al. | 73/865.7 |
| 5,010,774 | 4/1991 | Kikuo et al. | 73/172 X |
| 5,148,706 | 9/1992 | Masuda et al. | 73/172 |
| 5,253,656 | 10/1993 | Rincoe et al. | 73/172 X |
| 5,357,804 | 10/1994 | Wesemann et al. | 73/172 X |
| 5,375,397 | 12/1994 | Ferrand et al. . | |
| 5,524,636 | 6/1996 | Sarvazyan et al. . | |

FOREIGN PATENT DOCUMENTS

WO95/10762 4/1995 WIPO .

OTHER PUBLICATIONS

K. O'Dea, "The prevalence of pressure sores in four European countries", Journal of Wound Care, Apr., vol. 4, No. 4, 1995, pp. 192–195.

Barnett et al., "Skin Vascular Reaction to Standard Patient Positioning on a Hospital Mattress", The Journal for Prevention and Healing Advances in Wound Care, Jan., 1994, 8 pages.

Barnett et al., "Skin Vascular Reaction to Short Durations of Normal Seating", Arch Phys Med Rehabil, vol. 76, Jun. 1995, pp. 533–540.

Ferguson–Pell et al., "Prototype Development and Comparative Evaluation of Wheelchair Pressure Mapping System", Assistive Technology, vol. 5, No. 2, 1993, pp. 78–91.

Burman et al., "Measuring pressure", Journal of Wound Care, vol. 3, No. 2, Mar. 1994, pp. 83–86.

*Primary Examiner*—Hezron Williams
*Assistant Examiner*—Willie Morris Worth
*Attorney, Agent, or Firm*—Barnes & Thornburg

[57] ABSTRACT

An apparatus and method for evaluating pressure interface performance of a support surface for supporting a body are provided. The method includes the step of providing an array of pressure sensors covering substantially the entire support surface. The pressure sensors each provide an output signal indicating interface pressure with the body at one of a plurality of separate pressure nodes on the support surface. The method also includes the steps of engaging the support surface with the body, and calculating a pressure index using interface pressure output signals from the array of pressure sensors at all active pressure nodes to generate a single numeric value indicating pressure interface performance of the entire support surface.

19 Claims, 5 Drawing Sheets

METHOD AND APPARATUS FOR EVALUATING A SUPPORT SURFACE

BACKGROUND AND SUMMARY OF THE INVENTION

The present invention relates to a method for evaluating a support surface for supporting a body of a patient. More particularly, the present invention relates to a method and apparatus for evaluating interface pressure performance of the support surface. Such an evaluation is beneficial for designers in their efforts to produce better support surfaces that will reduce the incidence of pressure ulcers.

Ten percent of all acute care patients in the U.S. and twelve percent in Europe, suffer from pressure ulcers (decubitus ulcers, bed sores) on any given day. More than half of these patients are over the age of 65. Pressure ulcers are painful for patients and can be very costly to treat. Efforts to reduce the rate of occurrence have mainly been focused on prevention of hospital acquired pressure ulcers.

One preventative approach has been through the improvement of patient support surfaces (i.e. beds, tables, stretchers, chairs, etc.) that minimize external forces (i.e. pressure and shear) on a patient's body. The ability to determine the performance of the support surfaces is required for the design of better surfaces and the interpretation of clinical outcomes. Designers have generally relied upon incomplete anthropometric data and subjective data from patients and clinicians to estimate performance of support surfaces.

Interface pressure, the loading between a patient's skin and the support surface, can be used to determine relative differences in support surface performances. Several different sensor technologies exist for the measurement of interface pressure, each with its particular performance characteristics. See, for example, U.S. Pat. Nos. 5,357,804; 5,253,656; 5,148,706; 4,827,763; 2,644,332; and 2,378,039. There are several common critical parameters for reliable interface pressure measurement including: overall size, flexibility, resolution, accuracy, and repeatability. Each of these parameters affects the reliability of collected data.

The type of data used in the evaluation of performance is equally important as the reliability of the data. The most commonly reported data is single value maximum pressures recorded at several "critical" areas of the body. These maximum pressures provide somewhat useful data, but they do not give any indication of the number of peak pressures, the overall size of the pressure peaks, the average pressure on the entire body, or even maximum peak pressures in locations of the body not considered "critical".

The present invention provides a single repeatable indicator of interface pressure performance that accounts for the magnitude, number and size of all pressure peaks as well as the overall average pressure on the body. A Pressure Index ($P_{index}$) has been developed in the present invention to provide a single numerical representation of the effectiveness of a support surface.

Support surfaces are used by a wide range of patients differing in height, weight, morbidity, etc., all of which will affect support surface performance. Since interface pressure results are highly dependent on the particular measurement system used, the test subjects, the head elevations, the testing environment, and the test procedure, it is not valuable to compare maximum pressure values or any data values from sources that do not have consistent equipment and test methods.

The system and standardized method of the present invention reliably and repeatably measures all the interface pressure characteristics, while adequately representing the desired population, and allowing for realistic patient positioning.

Interface pressure measurements are highly sensitive to subject variability and the method of subject placement. No two humans, even of the same weight and stature, are anatomically identical. Therefore, interface pressure data taken on humans can vary a significant amount from person to person and even from test to test. The method used to place the subject on the surface and any movement of the subject also directly influence the interface pressure data.

The test method of the present invention uses anthropometrically correct manikins to minimize subject variability and standardize method of subject placement. The manikins adequately represented at least 90% of the elderly (65–74 years old) US population. Illustratively, manikins representing a 4'10" (1.5 m) and 104 lb (47.2 kg) female, a 6'0" (1.8 m) and 213 lb (96.6 kg) male, a 5'2" (1.6 m) and 135 lb (61.2 kg) female, and a 5'5" (1.65 m) and 300 lb (136.1 kg) female are used for testing each support surface in the method of the present invention. It is understood that other manikin sizes may be used, if desired.

The manikins are constructed using the body height and weight as independent variables, regression equations from two U.S. Air Force studies were used to estimate the physical dimensions and weights of the individual segments of the body. The manikins are constructed using the weight and dimension data for each segment as a blueprint. Each segment is weighed several times throughout the construction process to verify that it is correct.

The manikins include a wooden shell with a steel skeletal system. The joints are created to mimic the human range of motion. For simplicity the motion of the head is limited to flexion extension, no rotation was allowed. Also no medial/lateral rotation of the leg or pronation/supination motion of the arm is provided. The motion of the spine is also limited to flexion/extension, no medial/lateral motion is provided. The spinal column is constructed of 5 interlocking "Y" shaped pin joints in order to simulate the flexibility of the human spine. The shoulder and hip joints are simulated using ball joints, while the ankle, knee, elbow, and neck are simulated using hinge joints. The joints of each manikin do limit the overall range of motion, but not the range of motion necessary to achieve the various positions tested.

The manikins are then covered with a thin layer of latex foam and polyurethane coated fabric. The foam and fabric is designed to simulate skin and subcutaneous fat layers while not introducing any time dependent properties to the manikin.

When reviewing the data of different support surfaces the boundary conditions of the test have practical importance. Typically, the interface pressure data reported is collected with the subject in the supine position (0° head elevation), using a very limited sample size, and with an inadequate representation of the relevant population. The head elevation of the bed has a great impact on performance since it changes the weight distribution on the support surface. The present invention uses a range of head elevations from 0 to 45 degrees which best represents the common positions utilized in the clinical setting for testing the support surfaces of a bed.

Illustratively, interface pressure measurements are taken at three elevations of the head section of the bed at 0, 30, and 45 degrees. The 0 degree head elevation is selected because it reflects a supine position, most commonly used in the hospital for critically injured or ill patients. The 30 degree head elevation is selected because it represents a typical head elevation caregivers place patients in during their recovery to promote clearing of the lungs and aid in healing. Finally, the 45 degree head elevation is selected because it is the highest elevation patients usually used in recovery activities (i.e. eating, watching television, etc.). The beds are raised to these positions using standard operating mode which also articulates the knee section of the bed as the head is elevated.

A gantry of the present invention allows the testing personnel to pre-position the manikins in the appropriate positions for each bed or chair position. It is important that the manikin's body not be drawn across the surface during loading, since this will introduce non-normal forces. The positions of the manikins are selected to allow all body parts of the manikin to contact the surface approximately at the same time, therefore minimizing non-normal loading of the skin of the manikin. The gantry also allows the reproducible placement of the manikins in the same position for every test. During the collection of data the gantry does not carry any of the weight of the manikin.

To test pressure on the manikin, a sensor pad is positioned on the support surface before the support surface moves into engagement with the manikin. Illustratively, the sensor pad detects pressure in over 8000 different nodes on the support surface as discussed below.

The $P_{index}$ is then calculated for each surface based on the node pressures. The $P_{index}$ is calculated using a mathematical equation discussed below to evaluate the closeness of a support surface to that of an ideal surface (one with a homogeneously distributed pressure of 10 mmHg across the entire interface area). The average pressure value of nodes having pressure greater than or equal to the optimum pressure as well as the standard deviation of these nodes from the average pressure are used to calculate the pressure index of the present invention.

According to one aspect of the present invention, a method is provided for evaluating pressure interface performance of a support surface for supporting a body. The method includes the step of providing an array of pressure sensors covering substantially the entire support surface. The pressure sensors provide an output signal indicating interface pressure with the body at a plurality of separate pressure nodes on the support surface. The method also includes the step of calculating a pressure index using all of the pressure nodes to generate a single numeric value indicating pressure interface performance of the entire support surface.

According to another aspect of the present invention, a method is provided for evaluating pressure interface performance of a support surface for supporting a body. The method includes the step of providing an array of pressure sensors on the support surface. The pressure sensors provide an output signal indicating pressure at a plurality of pressure nodes on the support surface. The method also includes the steps of aligning the support surface at a selected position, engaging the support surface with the body, determining which pressure nodes have a pressure value greater than an optimum pressure value, and storing the node pressure values greater than or equal to the optimum pressure value. The method further includes the steps of calculating an average of the stored node pressure values, calculating a standard deviation of the stored node pressure values from the average pressure value, and calculating a pressure index for the support surface based upon the average value, the standard deviation, and the optimum pressure.

In the illustrated method, the step of engaging the support surface with the body includes the steps of suspending a manikin over the support surface and moving the support surface upwardly into engagement with the manikin. The step of suspending the manikin over the support surface includes the steps of adjusting the position of the manikin to a selected position relative to the support surface based upon coded indicators formed on a support coupled to the manikin.

According to yet another aspect of the present invention, an apparatus is provided for evaluating pressure interface performance of a support surface for supporting a body. The apparatus includes an array of pressure sensors located on the support surface. The pressure sensors provide an output signal indicating interface pressure with the body at a plurality of different pressure nodes on the support surface. The apparatus also includes a processor coupled to the output signal from the array of pressure sensors. The processor includes means for generating a pressure index for the support surface based upon sampling all the plurality of pressure nodes to generate a numerical representation of the pressure interface performance for the entire support surface.

According to still another aspect of the present invention, an apparatus is provided for evaluating pressure interface performance of a support surface for supporting a body. The apparatus includes an array of pressure sensors located on the support surface. The pressure sensors provide an output signal indicating interface pressure with the body at a plurality of different pressure nodes on the support surface. The apparatus also includes a processor coupled to the output signal from the array of pressure sensors. The processor includes means for determining which pressure nodes have a pressure value greater than an optimum pressure value, for storing the node pressure values greater than or equal to the optimum pressure value, for calculating an average of the stored node pressure values, for calculating a standard deviation of the stored node pressure values from the average pressure value, and for calculating a pressure index for the support surface based upon the average value, the standard deviation, and the optimum pressure.

According to a further aspect of the present invention, an apparatus is provided for supporting a manikin in at least two different orientations for testing a support surface. The apparatus includes a gantry including a top frame, a plurality of connectors coupled to the manikin, and a plurality of fasteners configured to couple the connectors to the frame at selected positions for each of the at least two orientations of the manikin. The apparatus also includes first coded indicators on the frame for indicating a position for each of the connectors relative to the frame corresponding to the at least two different orientations of the manikin, and second coded indicators on each connector for indicating a required length of the connectors to position the manikin in each of the at least two orientations.

In one illustrated embodiment, the first and second indicators are color coded indicators, with a separate color representing each of the at least two orientations of the manikin. In another illustrated embodiment, the first and second coded indicators are numeric indicators, with a separate number representing each of the at least two orientations of the manikin.

Also in the illustrated embodiment, the connectors are chains having a plurality of links. The second coded indicators are coupled to predetermined links of the chain to indicate the required length for the chains to position the manikin in each of the at least two orientations. The manikin is adjustable to at least three separate positions corresponding to a support surface having a 0 degree head elevation, a 30 degree head elevation, and a 45 degree head elevation.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
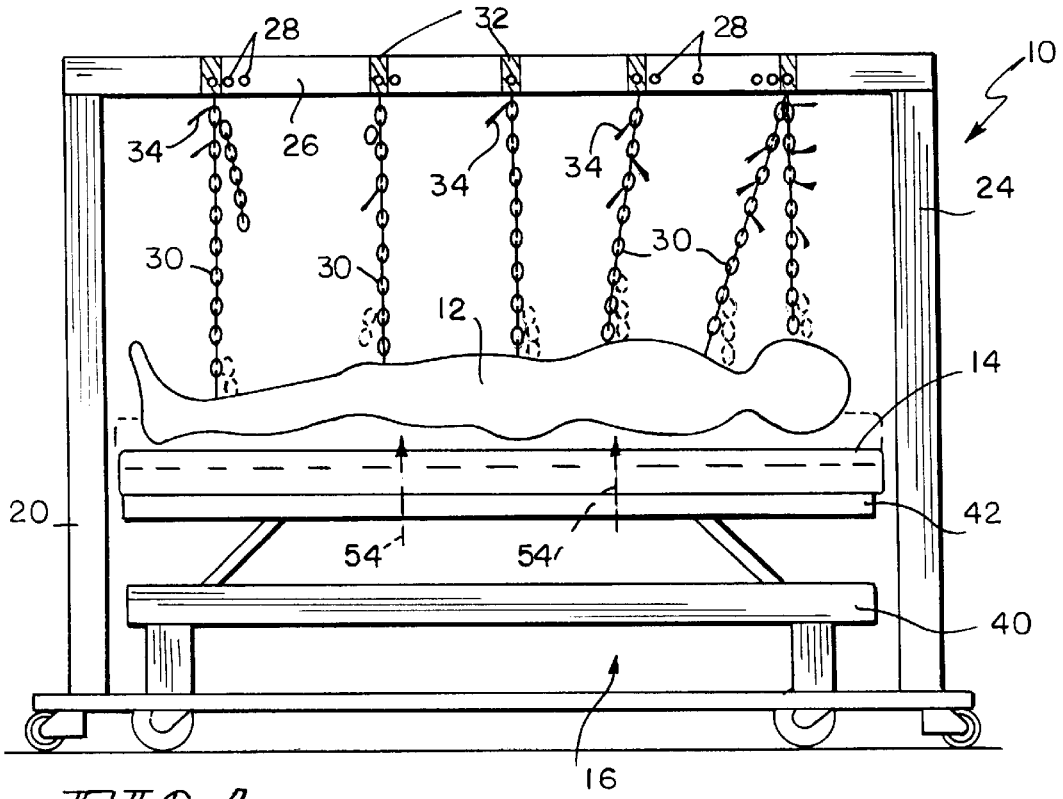
FIG. 1 is a diagrammatical side elevational view of a gantry for supporting a manikin in a predetermined position for engaging a support surface of a bed in which a head section of the bed is aligned at 0 degrees.
Figure 2:
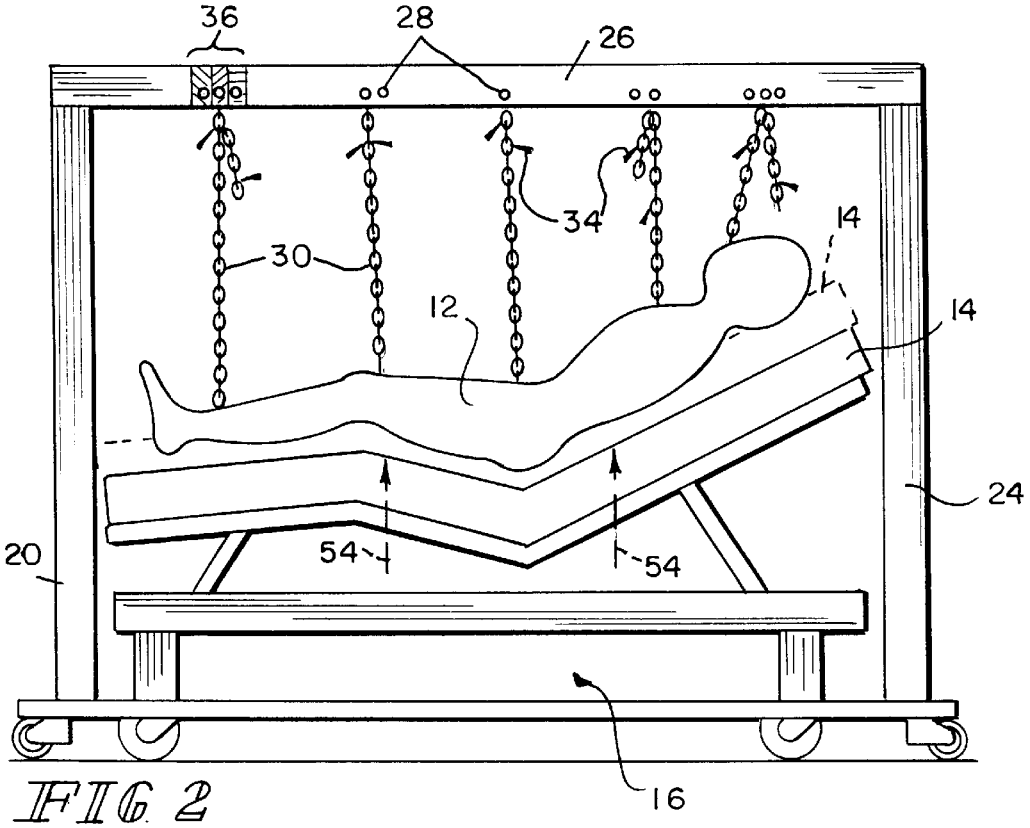
FIG. 2 is a side elevational view similar to FIG. 1 in which the location of chains supporting the manikin have been adjusted relative to a frame of the gantry to move the manikin to a second position for engaging the support surface of the bed aligned at a 30 degree head elevation.
Figure 3:
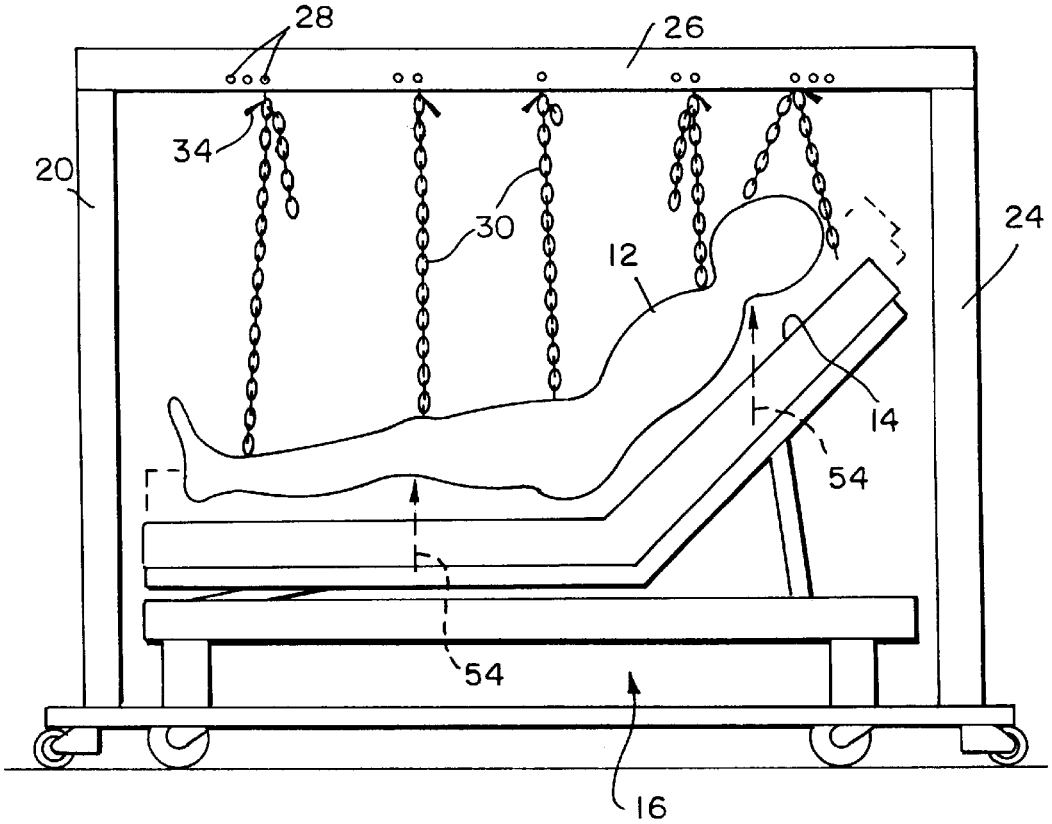
FIG. 3 is a side elevational view illustrating the manikin in a position for engaging the support surface when the head section of the bed is elevated to a 45 degree head deflection angle.
Figure 4:
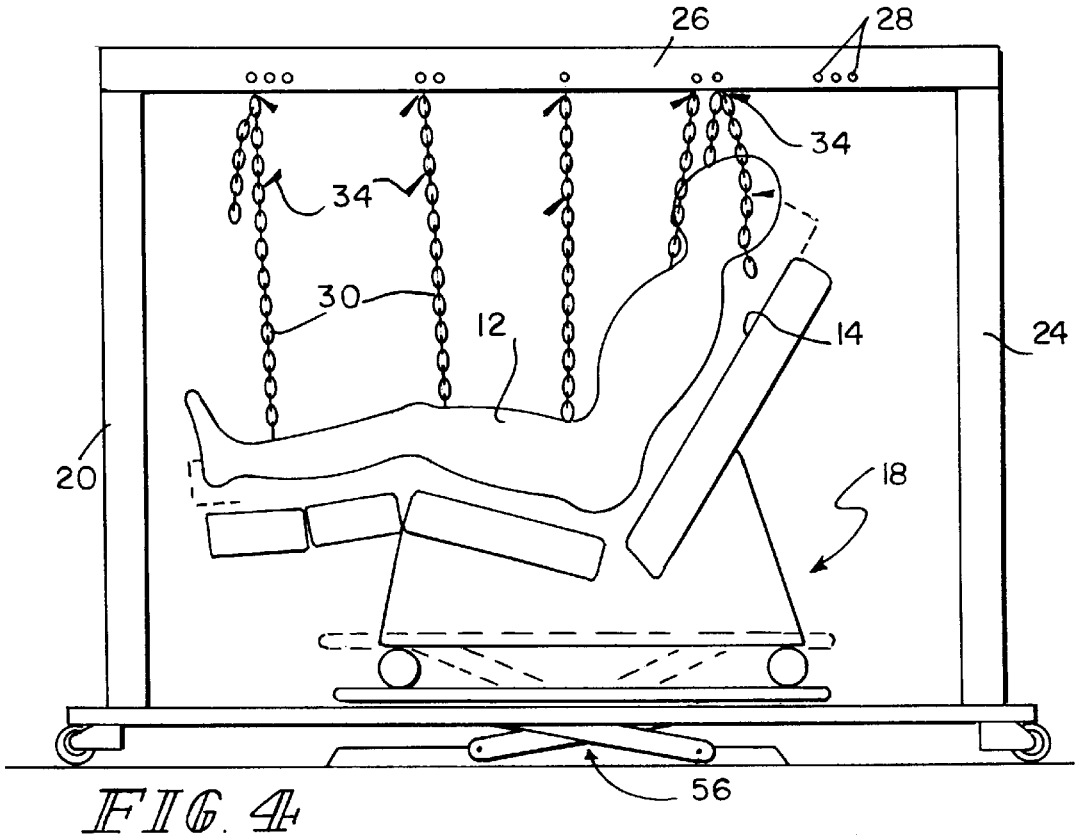
FIG. 4 is a side elevational view illustrating the configuration of the manikin on the gantry to engage a chair having a 60 degree head elevation.
Figure 5:
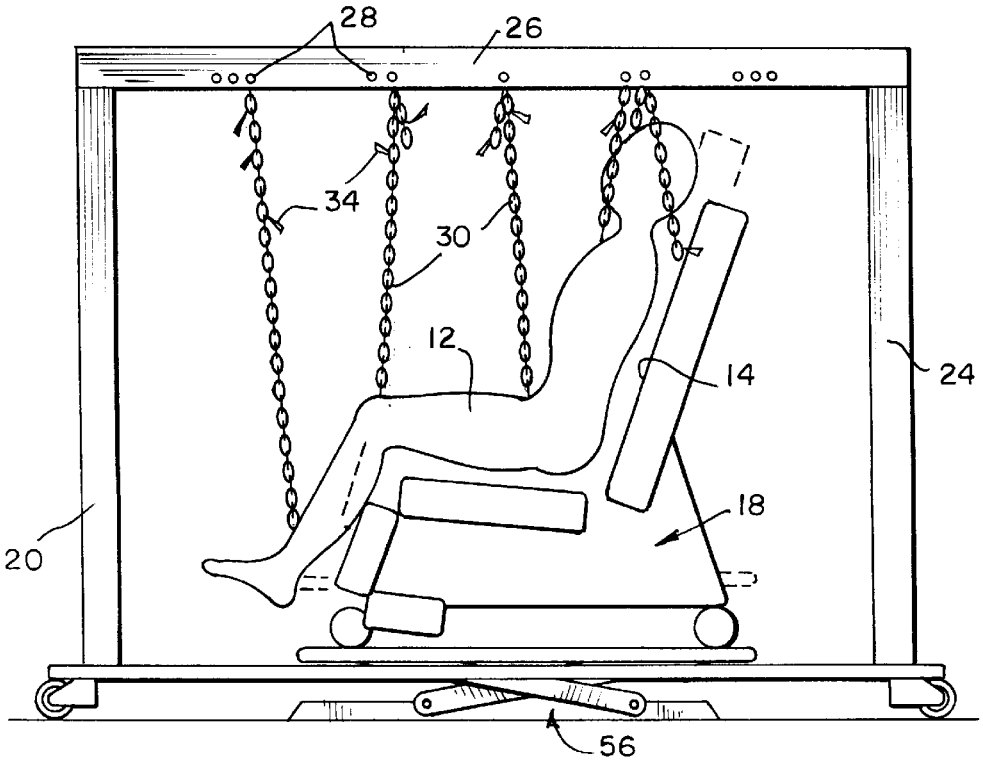
FIG. 5 is a side elevational view illustrating the configuration of the manikin on the gantry to engage a chair having a 70 degree head elevation.

Referring now to the drawings, FIGS. 1–5 illustrate a gantry 10 configured to support a manikin 12 in various orientations for engaging a support surface 14 on a bed 16 (FIGS. 1–3) or a chair 18 (FIGS. 4 and 5). Gantry 10 includes outer frame members 20 and 24 and a horizontal frame member 26. Frame 26 includes a plurality of apertures 28 configured to permit attachment of support chains 30 for supporting the manikin 12. The method and apparatus of the present invention is designed to test the effectiveness of the support surface 14 in various orientations. Therefore, the manikin 12 must be aligned in different positions for testing the bed in a flat or zero degree head elevation position shown in FIG. 1. The manikin has a different position or configuration for testing the bed in a 30 degree head elevation position of FIG. 2 and for testing the bed in the 45 degree head elevation position as shown in FIG. 3. In addition, the manikin 12 can be adjusted to test a support surface 14 of a chair 18 or a bed which is configured to be moved to a chair position. In FIG. 4, the head elevation is 60 degrees and in FIG. 5 the head elevation is 70 degrees.

Initial positions for manikin 12 are selected to minimize shear forces as the support surface 14 engages the manikin 12. Preferably, the manikin 12 is positioned so that the thighs and back of the manikin 12 contact the support surface 14 at the same time to reduce shear forces. An optimum position for manikin 12 is selected for each of the five illustrated bed and chair positions in FIGS. 1–5. Through trial and error, these optimum positions of manikin 12 are selected for each of the five bed and chair positions. These optimum manikin positions are marked using position indicators on both frame 26 and chains 30. For instance, frame 26 is marked with indicators such as color coding sections 32. Chains 30 are marked with corresponding indicator tags 34. Various colors or numbers can be used to indicate the optimum positions for the manikin 12 in each of the five orientations. As illustrated in region 36 of FIG. 2, the different colors or numbers advise the operator to move the chain to a particular location along frame 26 for a particular desired position of manikin 12.

In summary, for the five position testing system of the present invention illustrated in the drawings, five separate color codes or number codes are used on the frame 26 to indicate the position of each of the chains 30 along the frame 26 corresponding to each of the respective orientations of FIGS. 1–5. In addition, each individual chain 30 is marked with a matching color code or number code so that the length of the chain can be adjusted to match the optimum manikin position for FIGS. 1–5.

Figure 6:
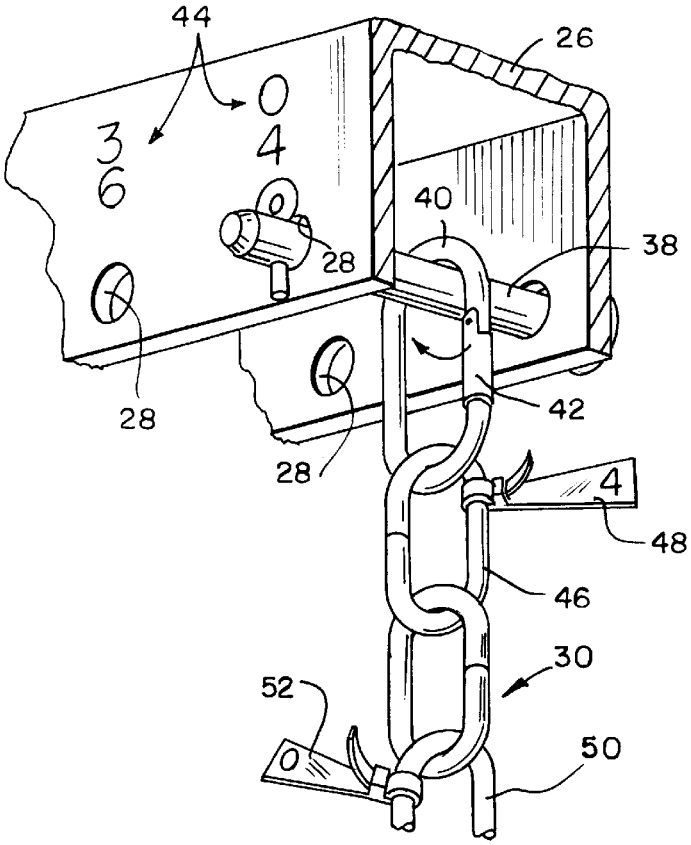
FIG. 6 is a perspective view illustrating a coding system on the gantry and on the claims to facilitate movement and positioning of the manikin between various test positions of FIGS. 1–5.
Figure 7:
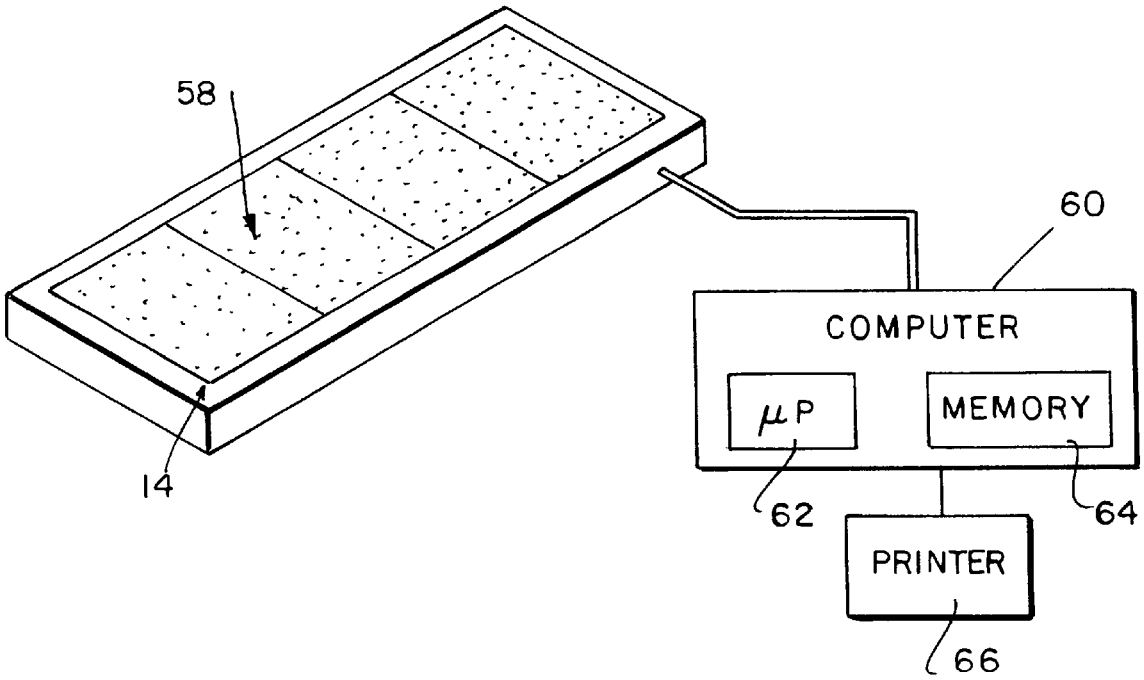
FIG. 7 is a diagrammatical view illustrating an array of sensors located on the support surface of the bed having an output coupled to a computer for processing the sensor signals to create a pressure index for the bed.

Further details of the manikin position adjusting mechanism are illustrated in FIG. 6. In FIG. 6, a numeric coding system is used instead of a color coding system. The frame 26 is illustratively a U-shaped frame. A cross pin 38 extends between spaced apart apertures 28. A coupler 40 including a moveable section 42 is used to couple the chains 30 to the pin 38 of frame 26. Numeric codes 44 are located on frame 26 adjacent selected apertures 28 to indicate the optimum position of chain 30 for a particular orientation. It is understood that the color coding of FIGS. 1–5 could also be used. In FIG. 6, 0 refers to a zero degree head elevation, 3 refers to a 30 degree head elevation, 4 refers to a 45 degree head elevation, and 6 refers to a 60 degree head elevation. Illustratively, the position for the 40 degree head elevation is shown in FIG. 6. The chain link 46 includes an indicator 48 to indicate that link 46 should be connected to coupler 40 for position 4. If it is desired to move the manikin to the 60 degree head elevation position, the chain 30 is moved to the left aperture 28 aligned with the number 6. In addition, link 50 of chain 30 having indicator tag 52 is moved to engage coupler 40.

After the manikin is appropriately adjusted for the particular test, the support surface 14 of bed 16 is moved upwardly in the directions of the arrows 54 to engage the manikin 12. It is understood that the manikin 12 may be lowered by the gantry to engage the support surface 14 if desired. The bed 16 includes a base 40 a deck 42 for supporting the support surface 14. A bed articulation controller is used to move the deck 42 to the various positions. A high-low mechanism is used to move the deck 42 up and down. The bed 16 is only shown diagrammatically in FIGS. 1–5. The bed articulation controller and high-low mechanism are shown diagrammatically in FIG. 3 as control mechanism 43. It is understood that any configuration bed may be used.

The controls of the bed are operated to move the deck 42 and support surface 14 upwardly in directions of arrows 54 until the support surface 14 engages manikin 12 and no weight of the manikin 12 is supported by the frame 26. If a chair 18 is tested without an internal high-low control, a separate lift assembly 56 may be provided.

In order to take pressure readings from the manikin on the support surface 14, an array of sensors 58 is located on the support surface 14. Illustratively, the array of sensors 58 is Tekscan Mattress Pressure Measurement System including model 5315 sensor pads (M-FPF001) and Tekscan software version 3.821S (M-SPP003). The Tekscan system is a resistive ink system that measures the reduction of resistance for each sensor element due to loading of the element in the normal direction. The full body sensing system has more than 8000 sensing elements or nodes with a resolution of 0.4 in×0.4 in (10.2 mm×10.2 mm) across the entire array of pads 58. The Tekscan system has some time dependent creep associated with its measurements, most of which occurs in the first 30 sec. after loading. Therefore, all data collection was done at about 75 sec. after loading which allows the system to stabilize for better repeatability. Each sensor node is continuously sampled up to 100 times per second. An output from sensors 58 is coupled to computer 60. Computer 60 includes a microprocessor 62 and memory 64. Computer 60 is coupled to a printer or a display 66.

The present invention provides a single numeric overall pressure index to provide an indication of the overall average interface pressure for a given sleep surface 14. The pressure index is a measure of both the difference between an overall average of the node pressures for the sleep surface 14 compared to an optimum pressure of 10 mmHg. The pressure index also depends upon how widely dispersed the individual node pressure values are from this overall range. The ideal surface would have a pressure index equal to 0. A less effective surface has a larger pressure index. The pressure index is calculated according to the following formula:

$$P_{index} = \sqrt{(M-10)^2 + (S)^2}$$

Where M is the mean or average of all pressure nodes greater than or equal to the optimum pressure. Illustratively, the optimum pressure value is selected as the 10 mmHg. The number 10 in the pressure index equation represents this theoretical optimum interface pressure value of 10 mmHg. This is the interface pressure that the entire contact surface of the human body would experience in an ideal support surface. S is the standard deviation from the average pressure of all pressure nodes above or equal to the optimum pressure. This standard deviation measures how dispersed the pressure values are from the average pressure. This means that a support surface in which all nodes pressures are equal would have a standard deviation of 0. A support surface where areas of high pressure nodes exist would have a standard deviation greater than 0.

Therefore, the best overall pressure index according to the present invention would be 0. Higher pressure indexes for support surfaces indicate less than optimum performance by the support surface.

Figure 8:
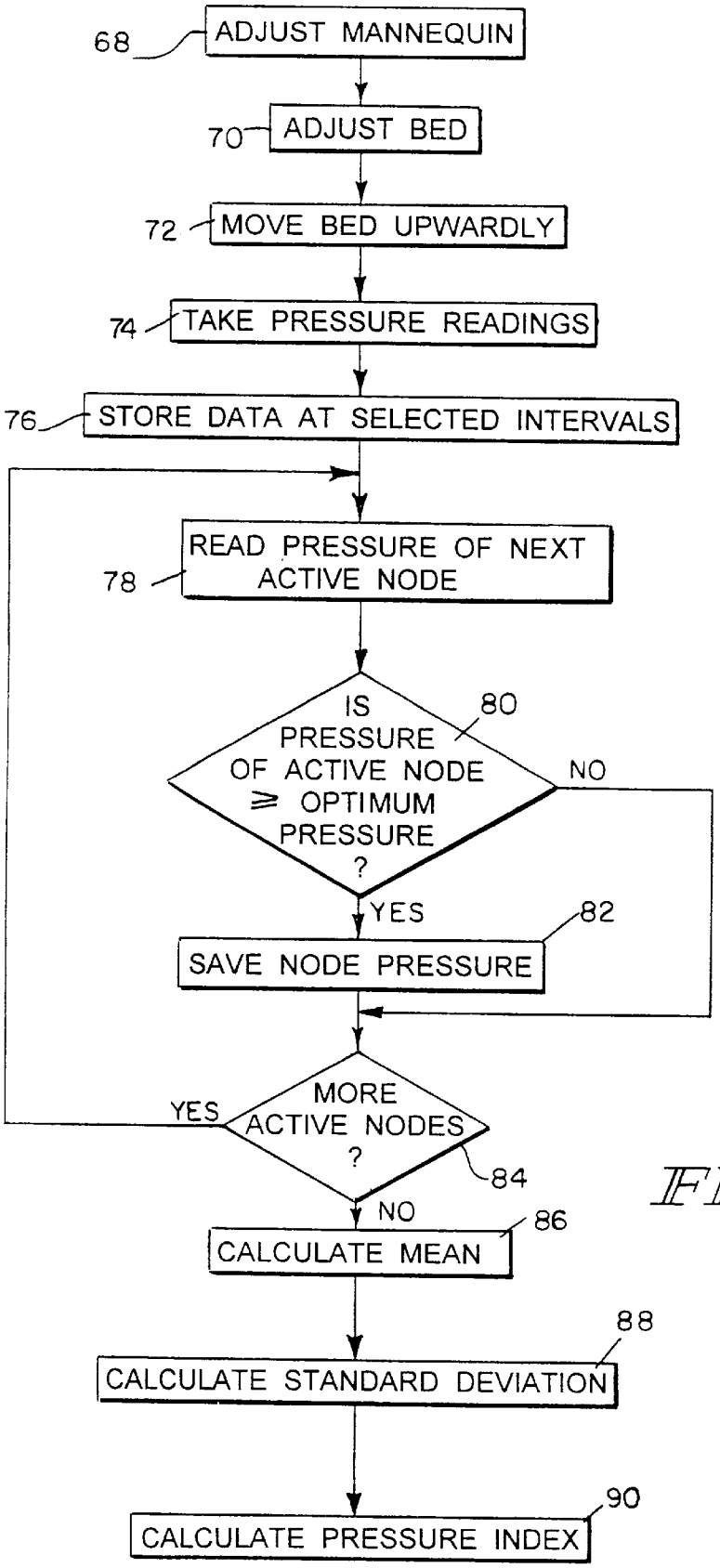
FIG. 8 is a flow chart illustrating the steps performed by the computer to process output sensor signals and generate the pressure index.

FIG. 8 illustrates the steps performed by computer 60 during a particular pressure test. First, the manikin 12 is adjusted to an optimum position for a particular bed orientation as shown in FIGS. 1–5. This step is illustrated at block 68 of FIG. 8. Next, the bed 16 or chair 18 is adjusted to its appropriate test orientation illustrated in FIGS. 1–5 as illustrated at block 70. Sensors 58 are already located on the support surface 14 of the bed 16 or the chair 18.

Next, the support surface 14 of bed 16 or chair 18 is moved upwardly toward the manikin 12 as illustrated at block 72. When the support surface 14 engages the manikin 12, sensors 58 generate output signals indicative of the pressure in each of the over 8,000 separate sensor nodes as illustrated at block 74. A data file indicating the pressure of each of the nodes can be saved at selected intervals. Typically, data is stored at block 76 after an interval of at least 75 seconds after loading of the pressure sensors to provide time for the sensors to stabilize for better repeatability.

After the data is stored in memory 64 of computer 60, microprocessor 62 reads the pressure of the first stored active node in which a pressure reading has occurred at block 78. Microprocessor 62 determines whether the pressure of the first active node is greater than or equal to the optimum pressure as illustrated at block 80. Illustratively, this optimum pressure is 10 mmHg. Active nodes under 10 mmHg are therefore discounted to reduce error due to noise in the system. If the pressure of the node is greater than or equal to the optimum pressure at block 80, microprocessor 62 saves the pressure value and node location in memory 64 as illustrated at block 82. Microprocessor 62 then advances to do block 84 to determine whether any more active node pressures were stored at block 76. If the pressure of the active node is less than the optimum pressure at block 80, microprocessor 62 advances directly to block 84 without saving the node pressure. If more active nodes are stored, microprocessor 62 returns to block 78 to read the stored pressure of the next active node.

If no more active nodes are stored at block 84, microprocessor 62 calculates an average or mean value for all the pressure nodes which exceed or equal the optimum value and were saved at block 82. This mean calculation step is illustrated at block 86. Next, microprocessor 62 calculates a standard deviation from the average pressure for the node pressure values saved at block 82 as illustrated at block 88. The microprocessor 62 then uses the formula disclosed above to calculate the pressure index for the support surface as illustrated at block 90. The pressure index can then be sent to a printer or display 66.

The pressure index of the present invention provides a method for evaluating interface pressure performance of a support surface 14 relative to other support surfaces. Once the basic pressure index calculation method has been determined, various testing procedures can be developed to evaluate and compare support surfaces 14. One such testing method includes providing manikins having various sizes representing different types of patients which may use the support surface. Selected manikin sizes are discussed above.

During a preferred test procedure, three repetitions of each test are made at each head elevation and for each manikin. It is desirable to test each support surface or bed 16 at the 0 degree, 30 degree, and 45 degree head elevations with each of the four manikins, each of the four manikins is tested three times at each of the three positions. In another words, 36 total tests would be made for each support surface on bed 16. Some beds are capable of moving to a chair position such as illustrated in FIGS. 4 and 5. In this instance, the support surface 14 is also tested in the chair positions.

Once all the test results are obtained, an overall average can be calculated for the particular support surface 14. In addition, averages for each of the various head positions can be determined separately. Since the sensors 58 generate many node pressures, a pressure index in different regions of the support surface can be calculated, if desired. Virtually unlimited types of tests can be run and used for comparison using the pressure index of the present invention.

Although the invention has been described in detail with reference to certain preferred embodiments, variations and modifications exist within the scope and spirit of the present invention as described and defined in the following claims.

What is claimed is:

1. A method for generating an indicator to evaluate pressure interface performance of a support surface, the method comprising the steps of:

providing an array of pressure sensors on the support surface to define a plurality of pressure nodes on the support surface, each of the pressure sensors providing an output signal indicating a node pressure value at one of the plurality of pressure nodes on the support surface;

aligning the support surface at a selected position;

providing a body configured to engage the support surface;

engaging the support surface with the body;

determining which of the plurality of pressure nodes have a node pressure value greater than or equal to an optimum pressure value;

storing the node pressure values greater than or equal to the optimum pressure value;

calculating an average of the stored node pressure values;

calculating a standard deviation of the stored node pressure values from the average pressure value; and calculating a pressure index for the support surface based upon the average value, the standard deviation, and the optimum pressure.

2. The method of claim 1, wherein the step of engaging the support surface with the body includes the steps of suspending the body over the support surface and moving the support surface upwardly into engagement with the body.

3. The method of claim 2, wherein the step of suspending the body over the support surface includes the steps of adjusting the position of the body to a selected position relative to the support surface.

4. The method of claim 1, wherein the array of pressure sensors covers substantially the entire support surface.

5. The method of claim 4, wherein all active pressure nodes are used during the determining step.

6. The method of claim 1, wherein the pressure index provides a single numeric value representing the pressure interface performance of the entire support surface.

7. A support surface testing apparatus comprising:

a manikin;

a gantry including a top frame;

a plurality of connectors coupled to the manikin;

a plurality of fasteners configured to couple the connectors to the frame at selected positions for each of the at least two orientations of the manikin;

first coded indicators on the frame for indicating a position for each of the connectors relative to the frame corresponding to the at least two different orientations of the manikin; and second coded indicators on each connector for indicating a required length of the connectors to position the manikin in each of the at least two orientations.

8. The apparatus of claim 7, wherein the first and second indicators are color coded indicators, with a separate color representing each of the at least two orientations of the manikin.

9. The apparatus of claim 7, wherein the first and second coded indicators are numeric indicators, with a separate number representing each of the at least two orientations of the manikin.

10. The apparatus of claim 7, wherein the connectors are chains having a plurality of links, the second coded indicators being coupled to predetermined links of the chain to indicate the required length for the chains to position the manikin in each of the at least two orientations.

11. The apparatus of claim 7, wherein the manikin is adjustable to at least three separate positions corresponding to a support surface having a 0 degree head elevation, a 30 degree head elevation, and a 45 degree head elevation.

12. A method for evaluating pressure interface performance of a support surface, the method comprising the steps of:

providing an array of pressure sensors covering substantially the entire support surface, the pressure sensors each providing an output signal indicating interface pressure with the body at one of a plurality of separate pressure nodes on the support surface;

providing a body configured to engage the support surface;

engaging the support surface with the body; and calculating a pressure index using interface pressure output signals from the pressure sensors at active pressure nodes to generate a single numeric value indicating pressure interface performance of the entire support surface.

13. An apparatus for evaluating pressure interface performance of a support surface for supporting a body, the apparatus comprising:

an array of pressure sensors located on the support surface, the pressure sensors each providing an output signal indicating interface pressure with a body at one of a plurality of different pressure nodes on the support surface; and a processor coupled to the array of pressure sensors, the processor including means for generating a pressure index for the support surface based upon sampling the output signals from pressure sensors at all the active pressure nodes, the pressure index providing a single numerical representation of the pressure interface performance for the entire support surface.

14. An apparatus for evaluating pressure interface performance of a support surface for supporting a body, the apparatus comprising:

an array of pressure sensors located on the support surface, the pressure sensors each providing an output signal indicating interface pressure with the body at one of a plurality of different pressure nodes on the support surface; and a processor coupled to the array of pressure sensors, the processor including means for determining which pressure nodes have a pressure value greater than or equal to an optimum pressure value, for storing the node pressure values greater than the optimum pressure value, for calculating an average of the stored node pressure values, for calculating a standard deviation of the stored node pressure values from the average pressure value, and for calculating a pressure index for the support surface based upon the average value, the standard deviation, and the optimum pressure, the pressure index being a numerical representation of the pressure interface performance of the support surface.

15. The apparatus of claim 14, further comprising a gantry for suspending the body over the support surface and a control mechanism for aligning the support surface at a selected position and for moving the support surface upwardly into engagement with the body.

16. The apparatus of claim 15, wherein the gantry includes a top frame, and further comprising a plurality of connectors coupled to the body, a plurality of fasteners configured to couple the connectors to the frame at selected positions for positioning the body in at least two different orientations for testing the support surface, first coded indicators on the frame for indicating a position for each of the connectors relative to the frame corresponding to the at least two different orientations of the body, and second coded indicators on each connector for indicating a required length of the connectors to position the body in each of the at least two orientations.

17. The apparatus of claim 16, wherein the connectors are chains having a plurality of links, the second coded indicators being coupled to predetermined links of the chain to indicate the required length for the chains to position the body in each of at least two orientations.

18. The apparatus of claim 14, wherein the array of pressure sensors covers substantially the entire support surface.

19. The apparatus of claim 18, wherein the pressure index provides a single numeric value representing the pressure interface performance of the entire support surface.

* * * * *